US005938009A

United States Patent [19]

Huang

[11] Patent Number: 5,938,009

[45] Date of Patent: Aug. 17, 1999

[54] KEY SWITCH FOR A KEYBOARD

[75] Inventor: Gear Huang, Taipei, Taiwan

[73] Assignee: Silitek Corporation, Taipei, Taiwan

[21] Appl. No.: 09/138,651

[22] Filed: Aug. 24, 1998

[51] Int. Cl.[6] ..... H01H 13/70

[52] U.S. Cl. ..... 200/517; 200/345

[58] Field of Search ..... 200/5 A, 512, 200/517, 520, 341, 344, 345; 400/490, 491, 491.2, 495, 495.1

[56] References Cited

U.S. PATENT DOCUMENTS

| | | | |
|---|---|---|---|
| 4,156,802 | 5/1979 | Gilano et al. | 200/5 A |
| 4,439,646 | 3/1984 | Bouvrande | 200/5 A |
| 5,173,578 | 12/1992 | Tama | 200/345 |
| 5,380,970 | 1/1995 | Mizuno et al. | 200/523 |
| 5,442,152 | 8/1995 | Huang | 200/345 |

*Primary Examiner*—Michael Friedhofer
*Attorney, Agent, or Firm*—Rosenberg, Klein & Bilker

[57] ABSTRACT

A key switch includes a rubber cone supported on a membrane circuit board inside a keyboard, a key base covered on the rubber cone to hold a vertically slidably key cap, a spring holder cap vertically slidably coupled to the key cap inside the key base to hold spring between the key cap and the spring holder cap, the key cap has two inner hooks respectively extended from two opposite sides of a bottom coupling frame thereof for engagement with the spring holder cap, the spring holder cap having outward hooks raised from the topmost edge thereof at two opposite sides for engagement with the inner hooks of the key cap, the rubber cone being compressed by the spring holder cap to trigger a contact at the membrane circuit board and the spring suddenly extending out to produce a click sound when the key cap is depressed.

10 Claims, 6 Drawing Sheets

KEY SWITCH FOR A KEYBOARD

BACKGROUND OF THE INVENTION

The present invention relates to a key switch for a keyboard, and more particularly to such a key switch which is easy to assemble and inexpensive to manufacture and, which produces a click sound when depressed.

Regular key switches for computer keyboards include two types. Namely, the mechanical key switches and membrane key switches. Regular mechanical key switches are commonly comprised of a key base, a key cap with plunger means vertically slidably mounted in the key base, return spring means, which automatically pushes the key cap back to its former position after each operation, triggering spring means, which is welded to the circuit board of the keyboard and forced to trigger a contact at the circuit board and to produce a click sound upon each down stroke of the key cap. The assembly procedure of these mechanical key switches is complicated and the manufacturing cost of these mechanical key switches is high because the coupling and positioning structures of the parts of these mechanical key switches are complicated. Furthermore, when the key cap is moved vertically relative to the key base, noises tend to be produced, and the key cap tends to be jammed in the key base when depressed. In a membrane key switch, a rubber cone is mounted on a membrane circuit within a key base, and a key cap is vertically slidably coupled to the key base and depressed to compress the rubber cone, causing the rubber cone to trigger a contact at the membrane circuit. This structure of membrane key switch is soft in touch and produces little noise when depressed. However, this structure of membrane key switch does not produce a click sound to confirm positive triggering of the contact when depressed.

SUMMARY OF THE INVENTION

The present invention has been accomplished to provide a key switch for a keyboard which eliminates the aforesaid drawbacks. It is one object of the present invention to provide a key switch which produces a click sound to confirm positive triggering of the contact when depressed. It is another object of the present invention to provide a key switch which is easy to assemble. It is still another object of the present invention to provide a key switch which is inexpensive to manufacture.

According to one aspect of the present invention, the key switch comprises a rubber cone supported on a membrane circuit board inside a keyboard, a key base covered on the rubber cone to hold a vertically slidably key cap, a spring holder cap vertically slidably coupled to the key cap inside the key base to hold spring between the key cap and the spring holder cap, the key cap comprising a bottom coupling frame inserted into the key base two outer hooks respectively extended from two first opposite sides of the bottom coupling frame and respectively hooked in respective recessed hook holes inside the key base, and two inner hooks respectively extended from two second opposite sides of the bottom coupling frame thereof for engagement with the spring holder cap, the spring holder cap having outward hooks raised from the topmost edge thereof at two opposite sides for engagement with the inner hooks of the key cap, the rubber cone being compressed by the spring holder cap to trigger a contact at the membrane circuit board and the spring suddenly extending out to produce a click sound when the key cap is depressed. According to another aspect of the present invention, the inner hooks of the key cap each have a smooth guide face at an inner side respectively disposed in contact the outward hooks of the spring holder cap, the outer hooks of the key cap each have a smooth guide face an outer side respectively disposed in contact with a part of the key base. Therefore, the key cap can be smoothly moved up and down in the key base and the spring holder cap can be smoothly moved up and down in the bottom coupling frame of the key cap without causing noises.

DETAILED DESCRIPTION OF THE PREFERRED EMBODIMENT

Figure 1:
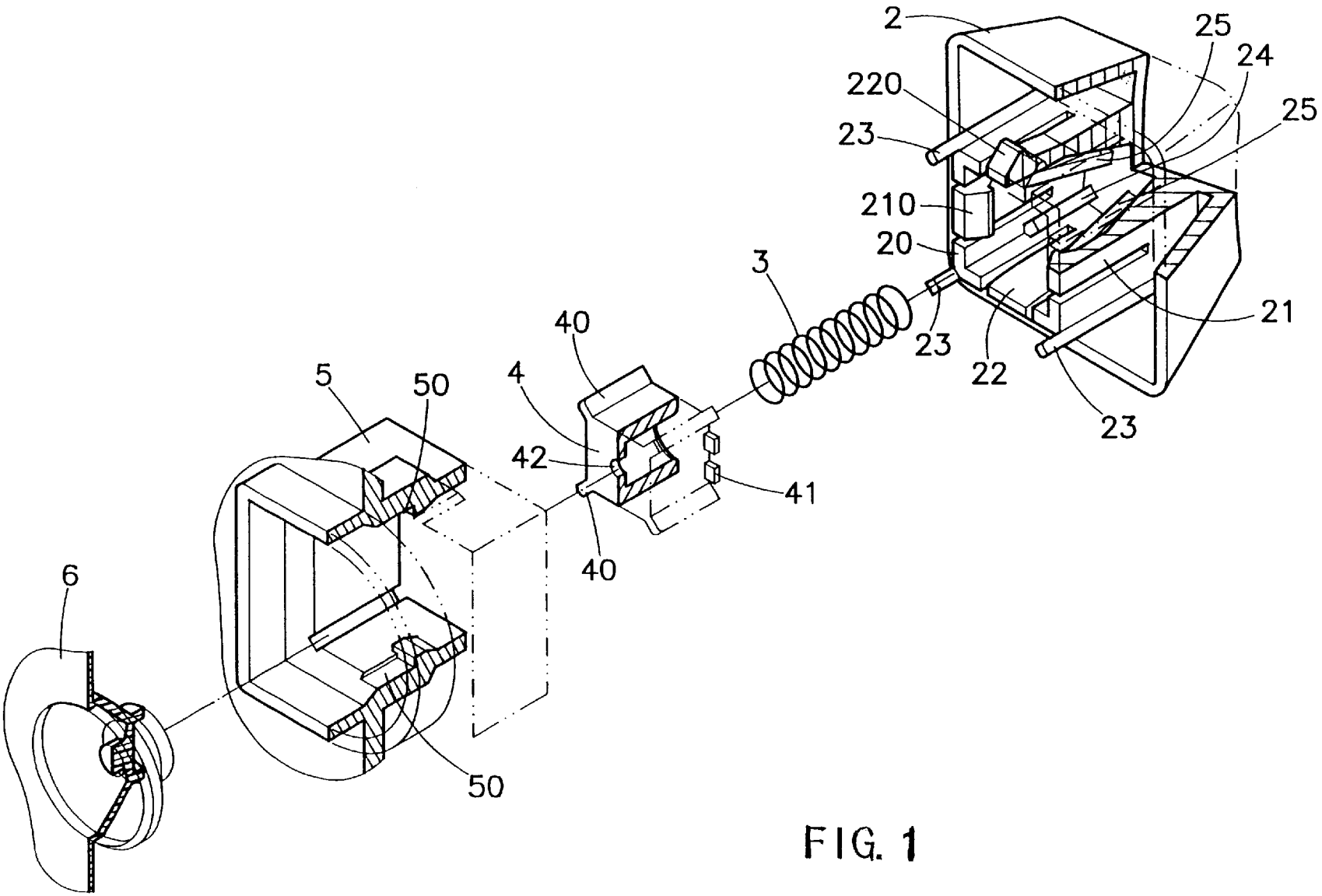
FIG. 1 is an exploded view of a key switch according to the present invention.
Figure 2:
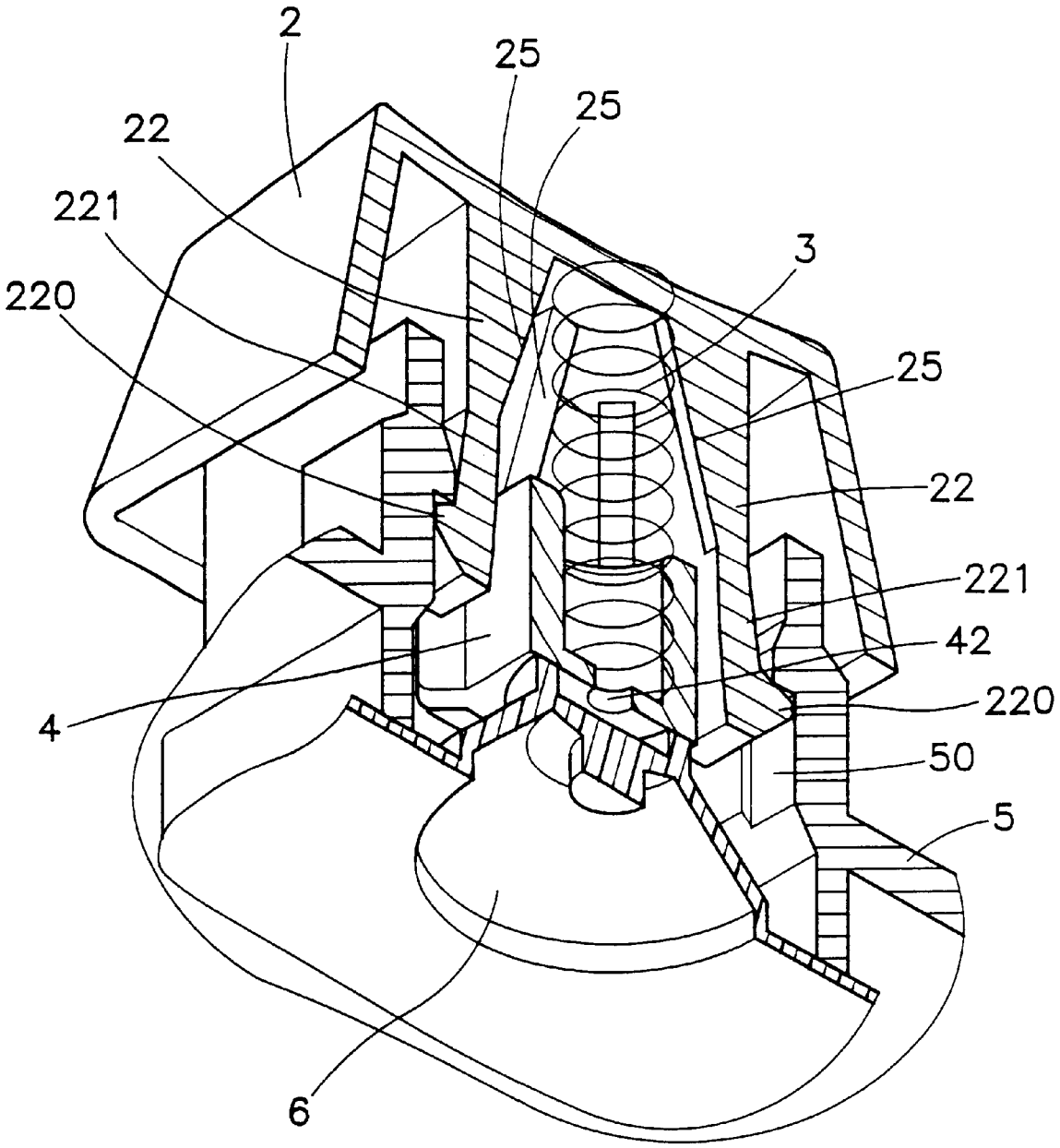
FIG. 2 is a sectional elevation of the key switch according to the present invention.
Figure 3:
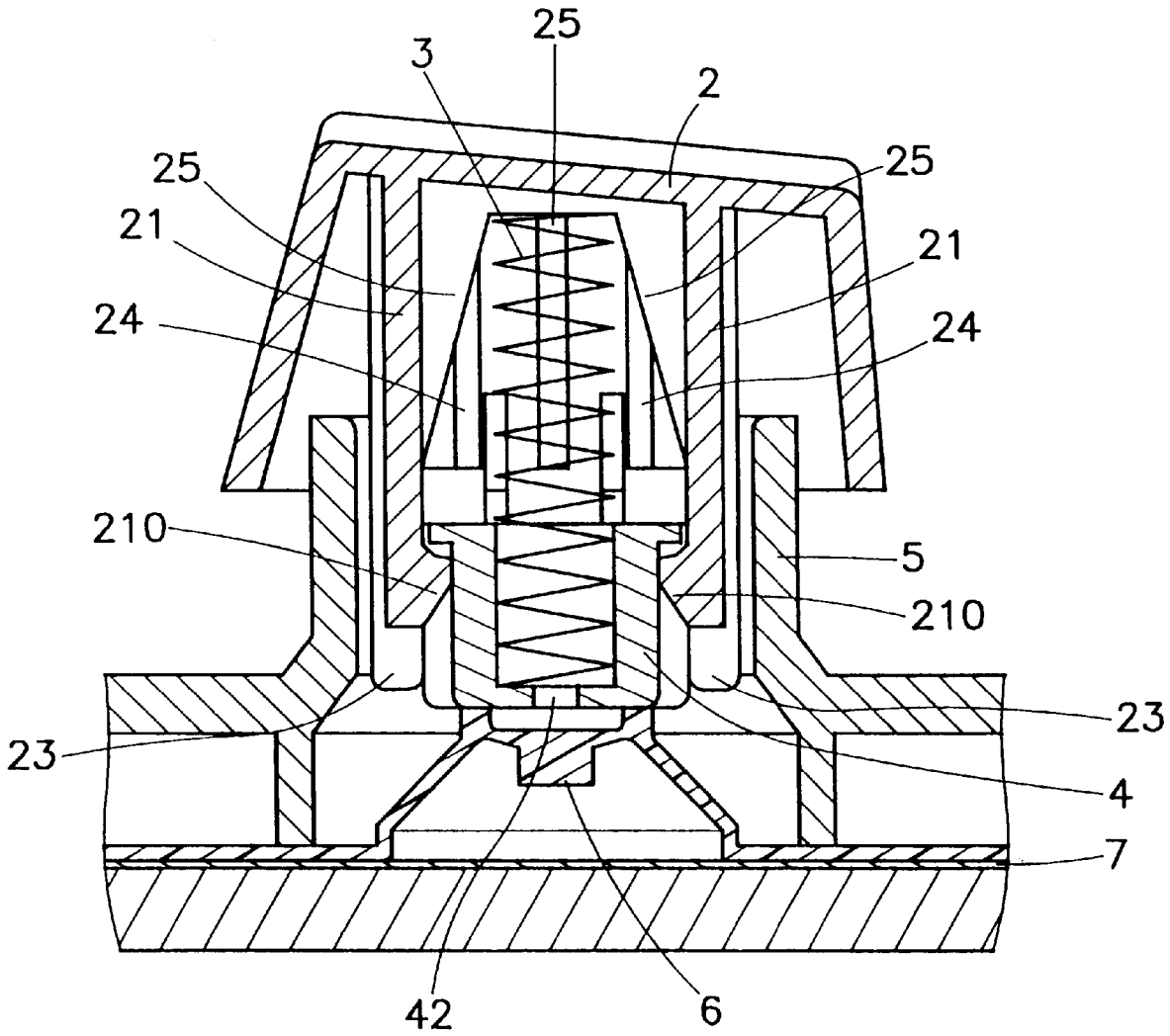
FIG. 3 is side view in section of the key switch according to the present invention.

Referring to FIGS. 1, 2 and 3, a key switch in accordance with the present invention is generally comprised of a rubber cone 6 supported on a membrane circuit board 7 inside a keyboard, a key base 5 covered on the rubber cone 6 above the membrane circuit board 7, a spring holder cap 4 mounted within the key base 5, a key cap 2 vertically slidably coupled to the key base 5 at the top, and a spring 3 connected between the key cap 2 and the spring holder cap 4.

The key cap 2 comprises a bottom coupling frame 20 suspended on the inside, two first downward hooks 21 respectively disposed at two first opposite sides of the bottom coupling frame 20, two second downward hooks 22 respectively disposed at two second opposite sides of the bottom coupling frame 20, four downward guide rods 23 respectively disposed in four corners outside the bottom coupling frame 20, four stop flanges 24 respectively disposed in four corners inside the bottom coupling frame 20, and four sloping guide ribs 25 respectively inwardly extended from the downward hooks 21,22 to the inside top wall of the bottom coupling frame 20. The first downward hooks 21 each have an inwardly extended hooked portion 210 at the end and a guide face 211 at an inner side above the hooked portion 210. The second downward hooks 22 each have an outwardly extended hooked portion 220 at the end and a guide face 221 at an outer side above the hooked portion 220. The guide face 211 or 221 can be a sloping or smoothly curved surface.

The spring 3 is received inside the bottom coupling frame 20 of the key cap 2 and surrounded by the sloping guide ribs 25. The spring holder cap 4 is covered on the bottom end of the spring 3, having a center through hole 42, four axially extended peripheral guide ribs 40 raised from the periphery in four corners thereof, and a plurality of outward hooks 41 outwardly raised from the topmost edge thereof at two opposite sides. When the spring 3 is inserted into the bottom coupling frame 20 of the key cap 2, the spring holder cap 4 is covered on the bottom end of the spring 3 and coupled to the key cap 2 by forcing the outward hooks 41 into engagement with the hooked portions 210 of the first downward hooks 21 of the key cap 2 respectively (see FIG. 3).

The key base 5 receives the bottom coupling frame 20 of the key cap 2, having two longitudinally extended recessed hook holes 50 bilaterally disposed on the inside for engagement with the hooked portions 220 of the second downward hooks 22 of the key cap 2. When the bottom coupling frame 20 of the key cap 2 is inserted into the key base 5, the rubber cone 6 imparts an upward pressure to the spring holder cap 4, and the hooked portions 220 of the second downward hooks 22 of the key cap 2 are respectively moved to the upper limit position and hooked on the top ends of the recessed hook holes 50 (see FIG. 4).

As indicated above, the assembly procedure of the key switch is simple, and comprises only two steps, namely, the first step of putting the spring 3 in the spring holder cap 4 and then inserting the spring holder cap 4 into the bottom coupling frame of the key cap 2, enabling the outward hooks 41 of the spring holder cap 4 to be respectively forced into engagement with the hooked portions 210 or the first downward hooks 21 of the key cap 2 and the axially extended guide rids 40 of the spring holder cap 4 to be respectively inserted into longitudinally grooved four corners inside the bottom coupling frame 20 of the key cap 2, and the second step of inserting the bottom coupling frame 20 of the key cap 2 into the key base 5, enabling the hooked portions 220 of the second downward hooks 22 of the key cap 2 to be respectively forced into engagement with the recessed hook holes 50 in the key base 5 and the downward guide rods 23 to be respectively inserted into longitudinally grooved four corners inside the key base 5.

Figure 4:
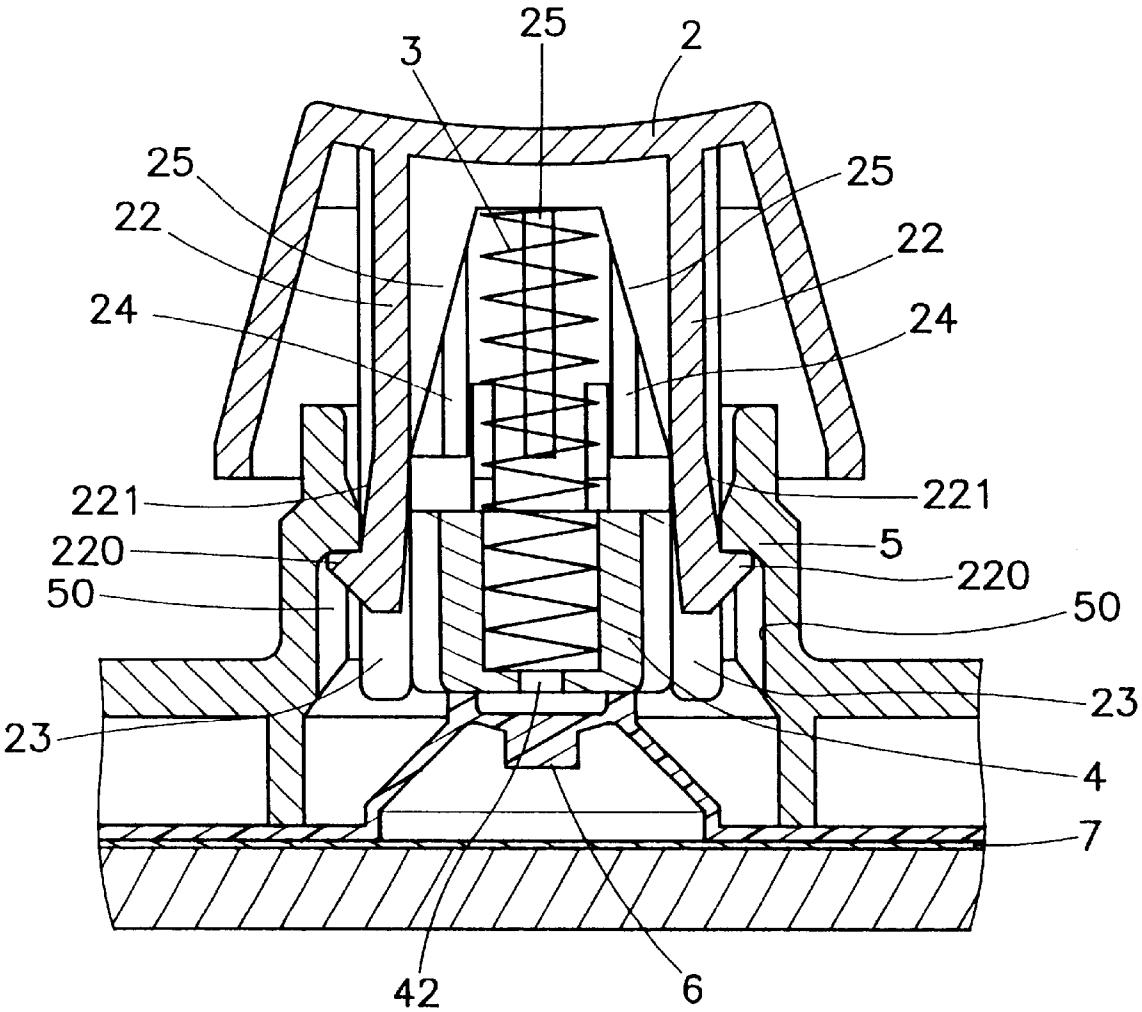
FIG. 4 is a front view in section of the key switch according to the present invention.
Figure 5:
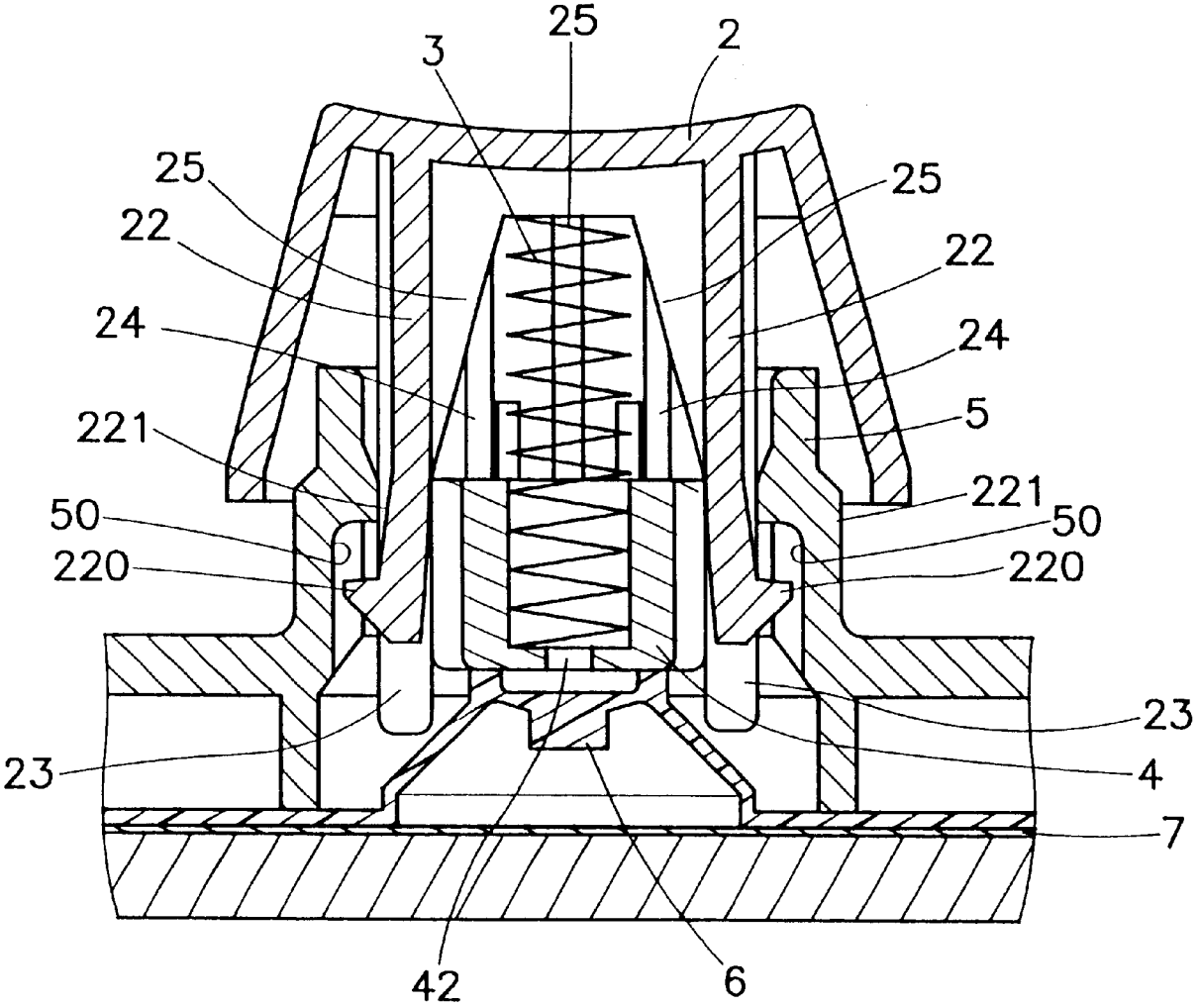
FIG. 5 is similar to FIG. 4 but showing the key cap depressed.
Figure 6:
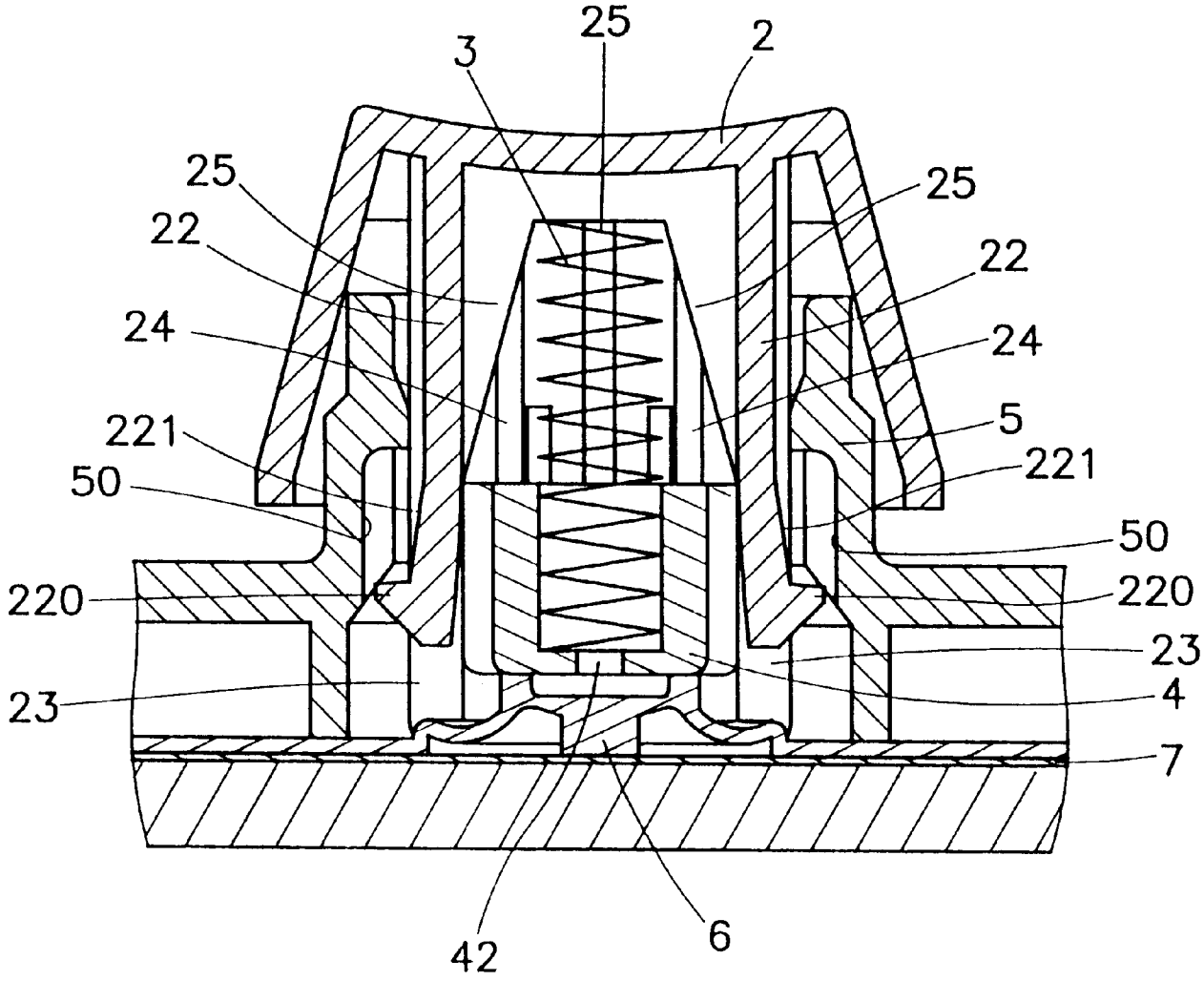
FIG. 6 is similar to FIG. 5 but showing the rubber cone deformed, the membrane circuit board triggered.

Referring to FIGS. 4, 5 and 6, when the key cap 2 is pressed down with the hand, the hooked portions 220 of the second downward hooks 22 of the key cap 2 are moved downwards from the top ends of the recessed hook holes 50 to the bottom ends thereof and disengaged from the outward hooks 41 of the spring holder cap 4. At the initial stage during the down stroke of the key cap 2, the spring holder cap 4 is forced by the upward pressure of the rubber cone 6 to compress the spring 2 against the downward moving key cap 2 (see FIG. 5). When the key cap 2 is continuously pressed down and the compressive force surpasses the bearing power of the rubber cone 6 (about 55 g), the four axially extended peripheral ribs 40 of the spring holder cap 4 are stopped at the stop flanges 24 inside the bottom coupling frame 20 of the key cap 2, and the spring 3 suddenly extends out to produce a click sound, and at the same time the rubber cone 6 is vertically downwardly deformed to touch a corresponding contact at the membrane circuit board 7, causing the membrane circuit board 7 to produce a corresponding electrical signal (see FIG. 6). Because the key cap 2 has guide faces 211 respectively disposed at the first downward hooks 21 above the respective hooked portions 210 and maintained in contact with the outward hooks 41 of the spring holder cap 4, sudden downward movement of the spring holder cap 4 does not cause the outward hooks 41 of the spring holder cap 4 to directly strike the hooked portions 210 of the first downward hooks 21 of the key cap 2 in producing a noise.

When the key cap 2 is released from the hand, the rubber cone 6 immediately returns to its former shape to push the spring holder cap 4 and the key cap 2 upwards. Because the spring holder cap 4 has a center through hole 42, no vacuum is produced in the spring holder cap 4 during the up stroke of the spring holder cap 4. When the key cap 2 is pushed back, the hooked portions 220 of the second downward hooks 22 ire respectively forced into engagement with the top ends of the recessed hook holes 50 inside the key base 5, and the hooked portions 210 off the first downward hooks 21 are respectively forced into engagement with the outward hooks 41 of the spring holder cap 4 again. By means of the guide faces 211 of the first downward hooks 21 are maintained in contact with the outward hooks 41 of the spring holder cap 4, and the guide faces 220 of the second downward hooks 22 are maintained in contact with a part of the key base 5, the spring, holder cap 4 be smoothly stably moved up and down in the key base 5 without producing a noise.

While only one embodiment of the present invention has been shown and described, it will be understood that various modifications and changes could be made thereunto without departing from the spirit and scope of the invention disclosed.

What the invention claimed is:

1. A key switch comprising:

a key cap having a bottom coupling frame inserted into a base and two outer hooks respectively extended from two opposite sides of said bottom coupling frame and respectively hooked in recessed hook holes formed inside said base, said key cap including two inner hooks respectively extended form two second opposite sides of said bottom coupling frame, said key cap further including a plurality of sloping guide ribs respectively inwardly extended from said inner hooks and said outer hooks to an inside top wall of said bottom coupling frame to hold a spring in said bottom coupling frame;

said spring being inserted between said guide ribs of said bottom coupling frame of said key cap; and, a spring holder cap disposed on a free end of said spring and supported by said spring and said two inner hooks such that said spring holder cap presses on a rubber cone on a membrane circuit board.

2. The key switch of claim 1 wherein said key cap comprises a plurality of stop flanges located inside said bottom coupling frame for stopping against a topmost edge of said spring holder cap.

3. The key switch of claim 2 wherein the outer hooks of said key cap each have a smooth guide face at an outer side thereof respectively disposed in contact with a portion of said key base.

4. The key switch of claim 1 wherein an outer side of said outer hooks and an inner side of said inner hooks have a sloping surface contour.

5. The key switch of claim 1 wherein an outer side of said outer hooks and an inner side of said inner hooks have an arcuate surface contour.

6. A key switch comprising:

a key cap having a bottom coupling frame inserted into a base and two outer hooks respectively extended from two opposite sides of said bottom coupling frame and respectively hooked in recessed hook holes formed inside said base, said key cap including two inner hooks respectively extended from two second opposite sides of said bottom coupling frame;

a spring being inserted between said guide ribs of said bottom coupling frame of said key cap; and, a spring holder cap disposed on a free end of said spring and supported by said spring and said two inner hooks such that said spring holder cap presses on a rubber cone on a membrane circuit board, said key cap further including (a) a plurality of stop flanges formed inside said bottom coupling frame for stopping against a topmost edge of said spring holder cap, and (b) a plurality of axially extended peripheral ribs corresponding to said stop flanges.

7. The key switch of claim 6 wherein said key cap comprises a plurality of sloping guide ribs respectively inwardly extended from said inner hooks and said outer hooks to an inside top wall of said bottom coupling frame to hold said spring in said bottom coupling frame.

8. The key switch of claim 7 wherein the outer hooks of said key cap each have a smooth guide face at an outer side thereof respectively disposed in contact with a portion of said key base.

9. The key switch of claim 6 wherein an outer side of said outer hooks and an inner side of said inner hooks have a sloping surface contour.

10. The key switch of claim 6 wherein an outer side of said outer hooks and an inner side of said inner hooks have an arcuate surface contour.

* * * * *